US007736415B2

(12) United States Patent
Colavito et al.

(10) Patent No.: US 7,736,415 B2
(45) Date of Patent: Jun. 15, 2010

(54) ROTARY LANCE

(75) Inventors: Dominick M. Colavito, Bangor, PA (US); John Damiano, Easton, PA (US); Yves Vermeulen, Pen Argyl, PA (US)

(73) Assignee: Specialty Minerals (Michigan) Inc., Bingham Farms, MI (US)

( * ) Notice: Subject to any disclaimer, the term of this patent is extended or adjusted under 35 U.S.C. 154(b) by 259 days.

(21) Appl. No.: 11/899,314

(22) Filed: Sep. 5, 2007

(65) Prior Publication Data

US 2009/0057964 A1 Mar. 5, 2009

(51) Int. Cl.
*C21C 7/00* (2006.01)

(52) U.S. Cl. ..... 75/526; 266/216

(58) Field of Classification Search ..... 266/216; 75/526

See application file for complete search history.

(56) References Cited

U.S. PATENT DOCUMENTS

| | | | | |
|---|---|---|---|---|
| 2,997,386 | A | | 8/1961 | Feichtinger |
| 3,212,882 | A | | 10/1965 | Garfinkle |
| 3,728,109 | A | | 4/1973 | Okubo et al. |
| 3,768,999 | A | | 10/1973 | Ohkubo et al. |
| 3,871,870 | A | | 3/1975 | Nemoto et al. |
| 4,154,604 | A | | 5/1979 | Gruner et al. |
| 4,481,032 | A | * | 11/1984 | Kaiser ..... 75/526 |
| 4,512,800 | A | | 4/1985 | Wirth, Jr. |
| 4,695,042 | A | | 9/1987 | Kudou |
| 6,383,253 | B1 | * | 5/2002 | Evertz et al. ..... 266/216 |
| 6,409,962 | B1 | | 6/2002 | Lawson |

FOREIGN PATENT DOCUMENTS

| | | | |
|---|---|---|---|
| GB | 2210867 | A | 6/1989 |
| JP | 362185811 | A | 8/1987 |
| SU | 673659 | A * | 7/1979 |

* cited by examiner

*Primary Examiner*—Scott Kastler
(74) *Attorney, Agent, or Firm*—Derek S. Jessen; Leon Nigohosian, Jr.

(57) ABSTRACT

A process and apparatus for feeding an additive to a molten metal in a vessel to achieve a uniform dispersion of the additive are provided. In one example, the outlet of the lance is positioned below the surface of the molten metal. The lance is moved with a reciprocating motion, so that the outlet of the lance moves below the surface of the molten metal. The additive is dispensed through the outlet of the lance along a path traversed by the outlet in the molten metal while the lance reciprocates.

22 Claims, 5 Drawing Sheets

ROTARY LANCE

FIELD OF THE INVENTION

The present invention relates to methods and apparatus for metal production.

BACKGROUND

In the production of steel, a steel melt is typically produced in a furnace and then tapped into a ladle, where it is treated with one or more ingredients for refining or alloying purposes. The steel produced in an electric arc furnace or in a basic oxygen furnace typically has a low carbon content and a high oxygen content. The oxygen content is typically reduced to a level below about 3 ppm for continuous casting. To lower the oxygen content, aluminum or silicon metal is generally added. However, addition of aluminum metal results in the formation of alumina (aluminum oxide) which is a very refractory inclusion. In a metal melt, all the inclusions typically do not float up to the surface of the molten metal and into the slag. To remove or modify these inclusions, calcium or calcium compounds such as $CaC_2$, CaAl and CaSi, or calcium briquettes or pellets are added to the melt to form a liquid calcium aluminate inclusion such as mayelite, $12CaO.7Al_2O_3$. Calcium also lowers the sulfur content of steel by the formation of calcium sulfides.

These materials are added to the melt in the furnace or in the ladle, or added by pouring the steel melt over the materials placed in the ladle. The amount of calcium added to the melt is relatively small as calcium has limited solubility in liquid steel, having a solubility in the 0.032% range. However, with all these methods the calcium yield is low and subject to considerable variations and, therefore, it is difficult to control the effect of calcium treatment. Furthermore, due to the low density of calcium relative to steel, and the volatility and reactivity of calcium with the molten metal, the addition of calcium to the molten metal is a complicated art.

Another approach utilizes a continuous feed of calcium or calcium composite wire enclosed within a steel sheath into the ladle or steel melt through a conduit positioned above the surface of the steel bath so as to be perpendicular to the surface of the molten bath. When this wire is introduced in a substantially vertical direction into the steel melt through the surface of the liquid slag/steel, the outer steel sheath delays the release of the low melting temperature, low density and highly reactive core materials, thereby increasing the calcium-molten steel mixing. Therefore the effectiveness of the calcium treatment is enhanced.

However, in such methods, the high volatility of calcium hinders the efficient utilization of the calcium additive. If the wire does not penetrate to a sufficient depth in the molten metal before the calcium in the wire desolidifies, a low residence time and poor utilization of the calcium results, along with a non-uniform treatment of the melt. In the case of surface-additive feeding, the additive needs to penetrate through the ladle slag. It is important that all or most of the calcium remain unreacted until the calcium descends at least to a critical depth at which the ferrostatic pressure is equal to the vapor pressure of calcium. If calcium desolidifies at ferrostatic pressures lower than its vapor pressure, large calcium vapor bubbles rise rapidly to the surface of the melt. The result is an inefficient, non-uniform treatment of the molten metal and the generation of a large amount of turbulence at the surface of the melt.

Another current approach feeds a calcium or calcium composite wire through a refractory lance submerged below the liquid steel surface. The submerged refractory lance serves to reduce the intensity of the calcium-steel reaction by introducing the solid calcium to the liquid steel at a point below the critical depth for volatilization of the calcium. This approach offers superior recovery to surface feeding of wire.

Improved metal treatment methods and apparatus are desired.

SUMMARY OF THE INVENTION

In some embodiments, a process feeds an additive to a molten metal in a vessel using a lance. The lance has an outlet. The outlet of the lance is positioned below the surface of the molten metal. The lance is oscillated, so that the outlet of the lance moves with a reciprocating motion below the surface of the molten metal. The additive is dispensed through the outlet of the lance, while the lance oscillates, along a path traversed by the outlet in the molten metal.

In some embodiments, a method of feeding an additive through a lance into a molten metal in a vessel includes providing a lance having a conduit extending therethrough. The conduit has an upper section and a lower section. The sections are in communication with each other. The lower section has an outlet. A longitudinal axis of the upper section of the conduit is angled with respect to a longitudinal axis of the lower section of the conduit. The lance is inserted within the vessel. The outlet of the conduit is positioned below the upper surface of the molten metal in the vessel. The lance is oscillated about the longitudinal axis of the upper section, so that the outlet of the lower section of the conduit moves with a reciprocating motion in the vessel. The material is fed through the conduit into the molten metal while the lance oscillates, so that the material is dispensed along a path traversed by the outlet of the lower section of the conduit in the molten metal.

In some embodiments, a lance is provided for feeding an additive wire into a vessel containing a molten metal. The lance has an outlet end. The lance has a refractory housing. An annular conduit is provided within the housing, through which the additive wire is fed into the molten metal. Means are provided for oscillating the lance while feeding the additive wire, so that the outlet of the lance moves below the surface of the molten metal while feeding the additive wire.

In some embodiments, a lance for feeding an additive wire into a vessel containing a molten metal has a refractory housing. A conduit, through which the additive wire is fed into the molten metal, is located within the housing. The conduit has an upper section and a lower section. The sections are in communication with each other. A longitudinal axis of the upper section is angled with respect to a longitudinal axis of the lower section. A motor is provided for oscillating the lance, so that the outlet of the lower section moves along an arc below the surface of the molten metal while feeding the additive wire.

DETAILED DESCRIPTION

Figure 1:
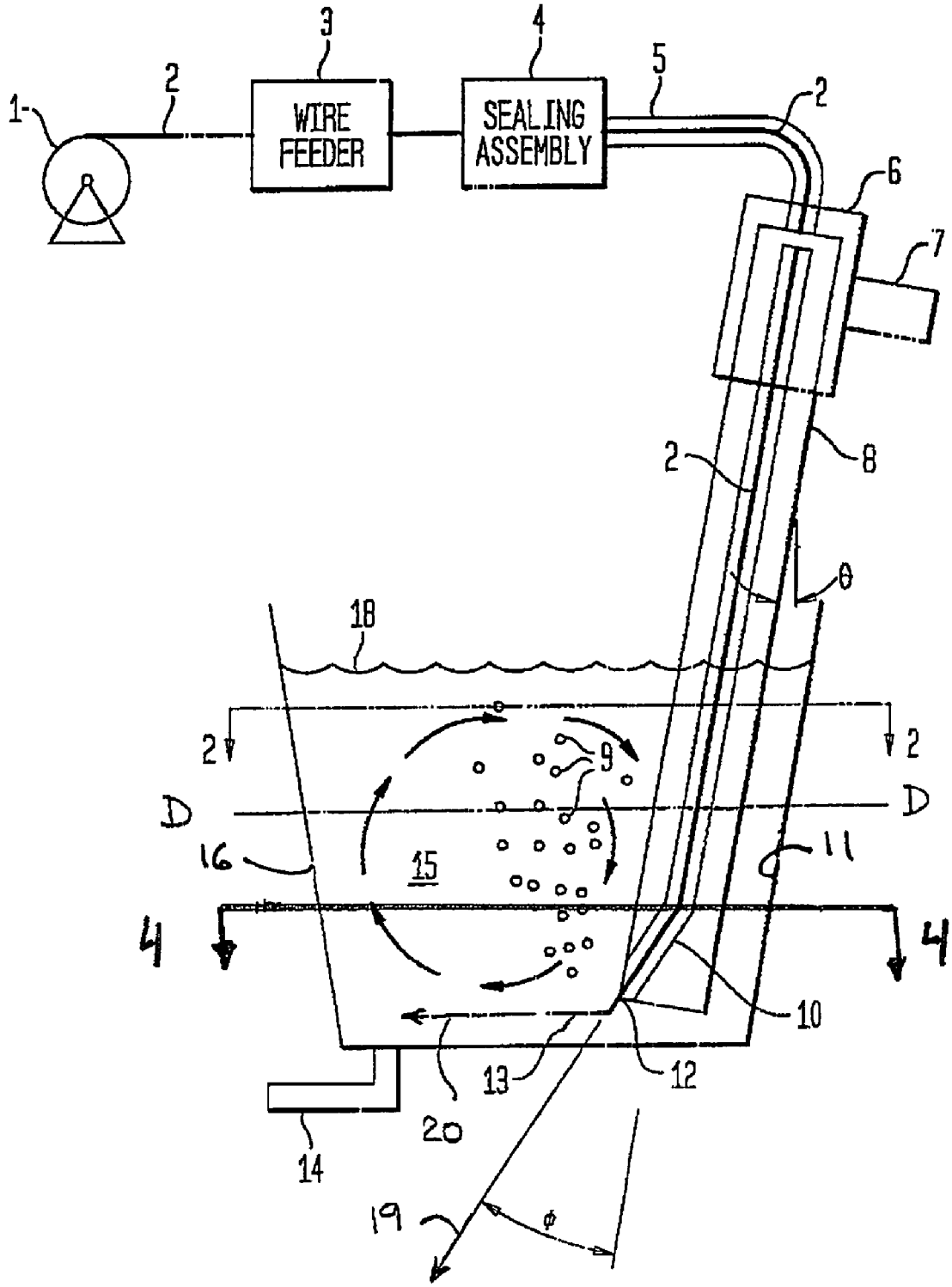
FIG. 1 is a schematic depiction of an apparatus for use in an exemplary process according to one embodiment of the present invention.

This description of the exemplary embodiments is intended to be read in connection with the accompanying drawings, which are to be considered part of the entire written description. In the description, relative terms such as "lower," "upper," "horizontal," "vertical,", "above," "below," "up," "down," "top" and "bottom" as well as derivatives thereof (e.g., "horizontally," "downwardly," "upwardly," etc.) should be construed to refer to the orientation as then described or as shown in the drawing under discussion. These relative terms are for convenience of description and do not require that the apparatus be constructed or operated in a particular orientation. Terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

Methods and systems according to some embodiments of the invention are described below, by way of examples only, with reference to the attached Figures. While one example disclosed herein includes steel as the material processed, and one example of the vessel is a ladle, the method and system are applicable to the refining of other metals using other types of vessels, for example, a furnace or the like. Further, the additives described below are only exemplary. One of ordinary skill in the art can readily select the appropriate additives to use if the molten metal 15 is a material other than steel.

Figure 2:
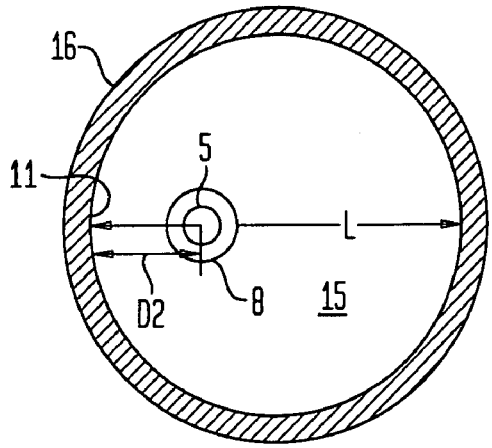
FIG. 2 is a cross-sectional view taken along the section line 2-2 in FIG. 1, showing the eccentric disposition of the refractory lance in the ladle.

FIGS. 1 and 2 show an apparatus for feeding an additive wire 2 into a bath of molten metal 15, such as molten ferrous material, contained in a ladle 16 which is open to the atmosphere. The ladle 16 has an outlet 14 for discharging material from the bottom of the ladle 16. Wire 2 is made by compressing or extruding an additive into the form of a wire. The additive wire 2 has a density lower than the molten metal 15. Examples of additives may include, calcium; calcium alloys (for example, a calcium-aluminum alloy), and/or other ingredients that are added to the molten metal for refining or alloying purposes (for example, aluminum, magnesium, rare earth elements, or the like). The calcium metal-containing wire 2 may be clad (for example, with a steel cladding), or unclad. If the wire 2 is clad, the core (e.g., a calcium metal-containing core) of the clad wire 2 may itself be a wire or may be present in any other form. For example, the additive may be in the form of a powder, granules, nuggets or other discrete shapes. In another embodiment, the material fed through the lance 8 into the molten metal 15 is a powder. Preferably, the surface layer 18 of the melt is a basic or acidic synthetic slag containing, for example, lime, silica and fluorspar which is added to the molten metal 15 prior to commencement of the wire feeding. As used herein, the terms "depth below the surface of the bath", "depth below the surface of melt 9", etc., refer to the depth below the slag/molten metal interface.

In some embodiments, as shown in the example of FIG. 1, the additive is formed into a wire, and the additive wire 2 is fed via a spool piece 1 and a mechanical wire feeder 3 into a sealing assembly 4 in communication with conduit 5. Conduit 5 is positioned and secured within a lance 8. An inert shielding gas, for example argon, or the like, is introduced in sealing assembly 4. The shielding gas prevents back-flow of the molten metal within bath of molten metal 15 into conduit 5 through conduit outlet 12. The wire 2 and shielding gas fed into conduit 5 are discharged through an opening 12 at the bottom of conduit 5 into the molten metal 15. Conduit 5 may be a continuous tube which is angled at its lower section (not shown in the drawing), or may comprise two or more sections, the lower section of which is generally angled with respect to the upper section of the conduit 5 as shown in FIG. 1. In some embodiments, the conduit 5 may be any straight or curved conduit having an outlet 12 that directs wire 2 in a direction that is angled with respect to a longitudinal axis of lance 8. (In FIG. 1, the longitudinal axis coincides with the location of wire 2 in the upper section of lance 8, and is not numbered separately). In some embodiments, the outlet 12 of the conduit 5 is offset from the central longitudinal axis of lance 8. An elevation adjustment and clamping mechanism (not shown) is used to raise and lower the lance 8 into the ladle 16.

In some embodiments, the lance 8 is oriented at an angle θ from vertical. In other embodiments, lance 8 may be substantially vertical (i.e., θ may equal 0). In some embodiments, the lance 8 is oriented at an angle θ that is about the same as the angle between the side wall 11 of the ladle 16 and the vertical direction, so that the lance 8 is parallel to the side wall 11.

In some embodiments, lance 8 comprises a generally cylindrical shaped housing, within which conduit 5 may be generally coaxially positioned and held in place. In the example of FIG. 1, the inlet and outlet of lance 8 are generally parallel to the longitudinal axis of the lance 8. Lance 8 is made of a refractory material, or fabricated using one or more materials, with the outer material comprising a refractory material to withstand the physical and chemical environment of the molten metal 15. A motor, which may be a variable speed motor 7 or a stepper motor, is connected to lance 8, to rotate lance 8 around its longitudinal axis. With lance 8 in rotation, the outlet 12 of conduit 5 oscillates along an arc, or moves along a circular path substantially in a plane, and substantially uniformly disperses the additive wire 2 into the molten metal 15 in a lower portion of the ladle 16, and along the arc or circular path traversed by a portion 13 of the additive wire 2 that projects beyond the outlet 12, initially in initial direction 19 that is controlled by the outlet direction and angle ϕ. The lower density of the portion 13 of the wire 2 with respect to the molten metal 15 creates a buoyant effect on the portion 13 of the wire 2. This causes the portion 13 of the wire 2 to curve upward from the initial direction 19 through a substantially horizontal second direction 20 whereupon complete melting and disintegration of the wire 2 has taken place. If the angle θ between the lance 8 and the vertical direction is small, then the path traced by outlet 12 lies within a substantially horizontal plane, so that the additive is dispensed at a substantially constant depth while lance 8 rotates or oscillates.

In other embodiments of the invention, the additive fed through conduit 5 may be in the form of a powder or pellets. In other embodiments of the invention, the lance 8 comprises a refractory housing with an annular space through which the additive is fed into the molten metal 15 in ladle 16.

If additive wire 2 has an exposed reactive material (e.g., elemental calcium metal) at its outer surface, such as if wire 2 is an unclad calcium metal wire, the wire 2 on spool 1 can be protected from atmospheric attack, for example, by maintaining spool 1 in a housing pressurized with a calcium-inert gas.

In some embodiments, lance 8 is oriented with its longitudinal axis at an angle θ with respect to the vertical direction and positioned adjacent to the side of ladle 16 as shown in FIGS. 1 and 2. Although FIG. 1 shows the lance 8 oriented at the same angle as an angle between the bottom and side wall 11 of the ladle 16, this is an optional orientation, and lance 8 may alternatively be positioned in a direction that is not parallel to a nearest side wall 11 of the ladle 16. In particular, the longitudinal axis of lance 8 may be positioned substantially vertically to dispense the additive at a substantially uniform depth.

The lance 8 is oscillated across an arc, for example through an arc greater than 0 degrees and less than or equal to about 210 degrees. In the case of an arc of 0 degrees, the lance 8 is stationary with the outlet 12 aimed at some predetermined point in the ladle 16. In some embodiments, the longitudinal axis of the lance 8 is substantially perpendicular to the bottom of ladle 16. In other embodiments, the lance 8 is positioned at or near the center of the ladle 16 and is rotated about its longitudinal axis through 360 degrees as the additive is dispensed through the lance 8. In yet other embodiments (not shown), the lance 8 is hinged or pivoted about its upper end, and the lance 8 is oscillated about this hinge or pivot so as to move the lower end of the lance 8 along a circular arc in the molten metal 15, as the additive is dispensed through the lance 8. In yet another embodiment, the lance 8 is movable along a vertical axis to allow the lower end of the lance 8 to be positioned at any depth below the surface of the steel melt. Preferably, if the lance 8 is moved vertically while dispensing the additive, the lance 8 remains at all times below the critical depth D (at which the ferrostatic pressure equals the vapor pressure of the additive at the melt temperature) while dispensing.

In another embodiment, the outlet 12 of the lance 8 is movable by translating the lance 8 across the lower portion of the molten metal 15 as the additive is dispersed through the lance 8, for example, by moving the lance 8 along a track above the molten metal 15. The track may trace a straight path across a diameter of the ladle, or may trace a circular path near the perimeter of the ladle. In other embodiments, translation of the lance 8 may be combined with rotation of the lance 8 around its axis, to enhance the uniformity with which the additive is dispersed.

Figure 3:
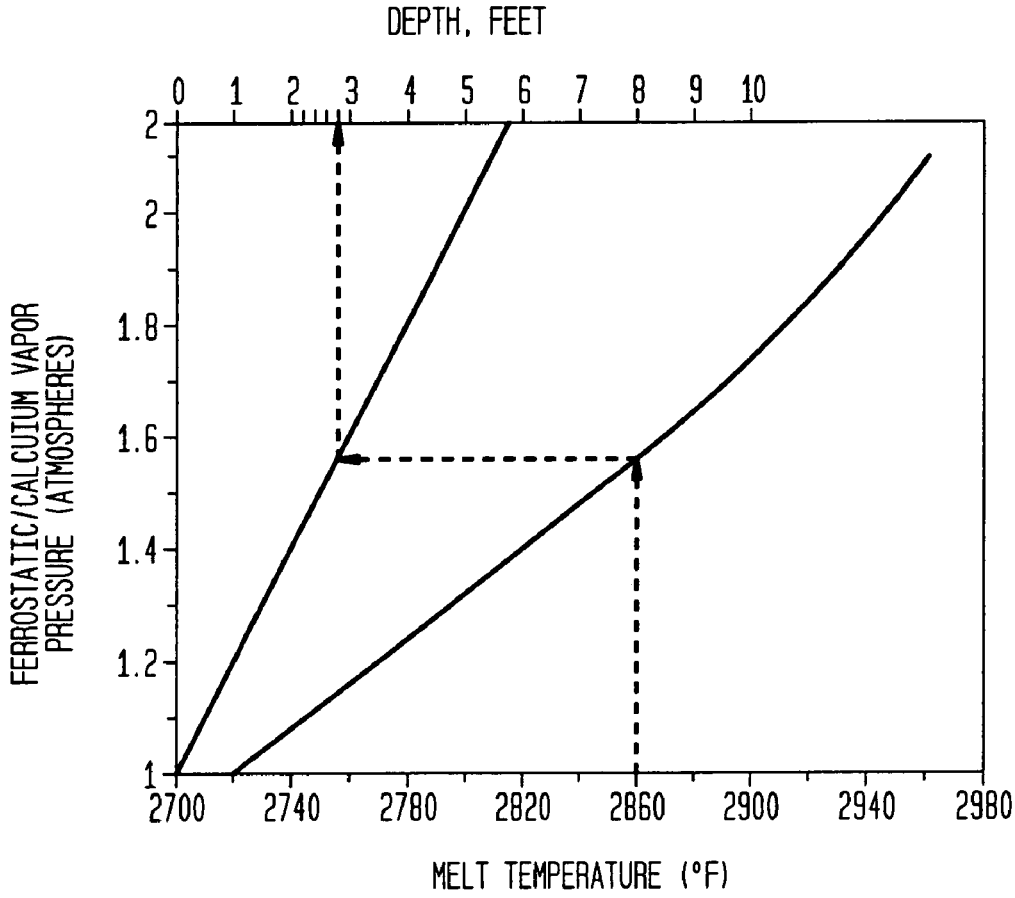
FIG. 3 is a chart that can be used to determine the critical depth of molten steel in a ladle, i.e., the depth below the surface of the molten steel at which the ferrostatic pressure equals the vapor pressure of an additive, for example, calcium, as a function of temperature.

In typical steel making operations, the temperature of the ferrous molten metal 15 in ladle 16 ranges from about 2800° F. to about 3000° F. At these temperatures, the vapor pressure of calcium is between about 1.3 and about 2.2 atmospheres (as shown in FIG. 3). A major part or all of the desolidification of the additive (e.g., elemental calcium metal) in wire 2 should occur by melting rather than by vaporization. Thus, this desolidification preferably occurs below the critical depth in the melt, which, in the example using a ferrous metal and a calcium additive, is defined as that depth below the surface of the melt at which the ferrostatic pressure is equal to the vapor pressure of calcium at the melt temperature. The critical depth may be readily determined as a function of temperature by using the chart provided in FIG. 3, or a corresponding chart of the same type for a different additive. The rightmost curve in FIG. 3 is a plot of calcium vapor pressure vs. temperature, while the leftmost curve is a plot of ferrostatic pressure vs. depth below the surface of the melt. At 2860° F., for example, the vapor pressure of calcium is 1.57 atmospheres. A ferrostatic pressure of 1.57 atmospheres is experienced at a depth of 2.8 feet, which is thus the critical depth at 2860° F.

An exemplary steel melt treatment operation proceeds as follows. The ladle 16 containing the molten steel arrives at the ladle station. Typically for steelmaking, a deoxidant such as aluminum or silicon has already been added to the ladle 16 and the composition of the steel has been analyzed. Based on the analysis, the amount of additives (for example, calcium) required to treat the steel melt is computed. Flow of an inert gas, for example argon, is started through conduit 5. The lance 8 is inserted into the ladle 16 so that the outlet 12 of the lance 8 is below the surface of the steel melt.

The additive wire 2 is fed through conduit 5 into the ferrous molten metal 15 with the lance 8 in oscillation along an arc greater than 0 and less than or equal to about 210 degrees using the variable speed motor 7 connected to the lance 8. In a preferred embodiment, the lance oscillates through an arc of about 106 degrees. With the lance 8 in oscillation, the additive wire 2 and the inert shielding gas are fed continuously into the molten metal 15 for about 0.5 minute to about 5 minutes depending upon the quality of the steel melt.

The inert shielding gas exits from the outlet 12 of conduit 5 and travels upwards through the molten metal 15 as a multiplicity of bubbles 9 to the surface of the melt 18. The pressure and flow rate of the inert shielding gas are sufficient to prevent back-flow of molten ferrous material through outlet 12 into conduit 5 and thus prevent blockage of the annular space by solidification of the molten metal 15. Moreover, the inert gas pressure and flow rate should preferably be sufficient to induce turbulence and thereby a mixing and stirring effect of the molten metal 15 in ladle 16 as shown schematically by arrows in the molten metal 15. The inert gas flow rate is adjusted so as not to generate excessive turbulence on the surface of the melt 18 as the inert shielding gas bubbles 9 rise to the melt surface and escape to the atmosphere.

A preferred range for the flow rate of inert shielding gas through lance 8 is from about $1.5\times10^{-5}$ to about $4\times10^{-5}$ standard ft.$^3$/(min. lb. of melt). Since the inert gas through conduit 5 does not propel the wire 2 into the melt, its flow rate through the lance 8 can be adjusted independently of the feed rate of wire 2. The inert gas pressure in conduit 5 is greater than the ferrostatic pressure at the additive wire outlet 12. When the computed amount of additive wire 2 has been added to the steel molten metal 15, the feed of the additive wire 2 to the ladle 16 is stopped, the oscillation of the lance 8 is shut off, lance 8 is retracted from the ladle 16, and the flow of the inert shielding gas through conduit 5 is shut off as soon as the lance 8 is above the slag layer.

Figure 4:
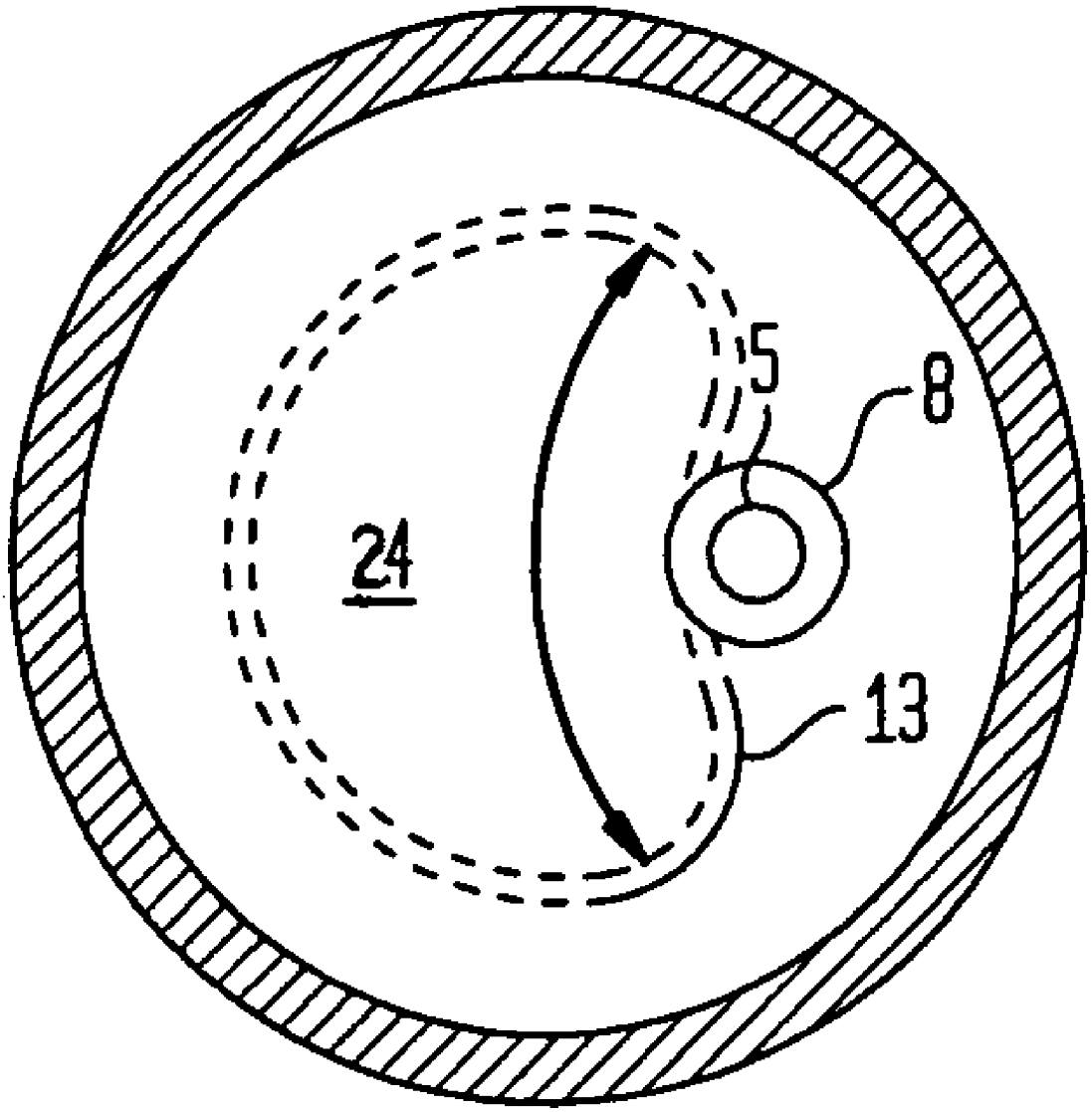
FIG. 4 depicts a schematic view of the vessel of FIG. 1, taken across sectional line 4-4.

Because the reaction between calcium and liquid steel is very violent and spontaneous, in conventional calcium additive processes, the calcium-molten steel reaction takes place in a localized, limited reaction volume in the steel melt. This results in non-uniform mixing of the calcium with the molten steel and, consequently, a non-homogeneous steel melt. The method and system disclosed herein increases the homogeneity of the steel melt by increasing the reaction volume and, therefore, the distribution of the calcium in the molten metal 15. This uniform distribution and reaction of the calcium with the melt is achieved by the below example of a method and system:

The additive wire 2 is discharged from outlet 12 in an initial direction 19 in the molten metal 15, a direction achieved by the outlet angle $\phi$ of the conduit outlet from about 3 degrees to about 30 degrees for a wire additive, or from about 3 degrees to about 90 degrees for a powder additive. The outlet 12 of lance 8 is moved through the molten metal 15 as the calcium wire 2 is discharged through the outlet 12 in initial direction 19, for example, by rotating lance 8 about its longitudinal axis. Movement of the portion 13 of the additive wire 2 that projects into the molten metal 15, across the lower portion of the ladle 16, initially follows initial direction 19 of the outlet shifting towards second direction 20 as the melting process progresses, disperses the additive across a greater volume of the molten metal 15 thereby increasing the reaction volume 24 as shown schematically in FIG. 4.

During the additive and inert gas feed process, the disposition of lance 8 in molten metal 15 is adjusted taking into account the composition, cross-sectional dimension and feed rate of wire 2 so that:

(a) the wire portion 13 of wire 2 is discharged from conduit outlet 12 into the molten metal 15 at an initial direction 19 determined by the angle ϕ and shifts towards second direction 20 before fully melting in the molten metal 15, and (b) the projecting portion 13 of wire 2 moves along an arc across the lower portion of the ladle 16 as the lance 8 is moved.

This is only one non-limiting example, and other variations may be practiced providing a desired degree of dispersion of a given additive in a given molten metal material.

As used herein, the term "disposition of the lance" or "lance disposition" encompasses any or all of the depth of the lance 8 in the molten metal 15, and/or its position in the bath in a three-dimensional coordinate system, and/or the orientation of the lance 8 with respect to the vertical, i.e., the degree and direction of its tilt, if any, away from the vertical. The variables of lance disposition, wire composition, wire cross-sectional dimensions, wire feed rate and the angle through which the lance 8 is rotated are interrelated, so that a change in one of the above variables may be accommodated by an adjustment in one or more of the remaining variables to obtain the same or similar results.

Thus, for example, it is preferred that lance 8 be disposed so that the wire outlet 12 is positioned below the critical depth D, while the wire 2 is being fed through the lance 8, as shown in FIG. 1. However, it is also possible to operate with the wire outlet 12 of the lance 8 at a point above the critical depth D. In this case, the wire feed rate, or the wire diameter may be increased to delay desolidification, so that the same or a similar result is achieved. In some embodiments, the lance 8 is non-centrally disposed in ladle 16, as shown in FIGS. 1 and 2. This eccentric disposition of lance 8 in ladle 16 serves to increase the volume of the target down-welling region in the recirculating molten metal 15 by concentrating down-welling on one side of the ladle 16.

One of ordinary skill in the art will understand that a reciprocating motion allows the lance 8 to be positioned closer to the side wall 11 of the vessel 16 than is possible if the lance 8 rotates continuously in one direction through a full 360 degree rotation, In some embodiments of the invention, the distance D2 (FIG. 2) between the longitudinal axis of lance 8 and the inner surface of the nearest side wall of ladle 16 (for example side wall 11 in FIGS. 1 and 2) is from about ⅙ to about ⅓ of the longest linear dimension L of the bath, as viewed in horizontal planes. This longest linear dimension L of the bath would be its major axis in the case of a ladle with elliptical or oval cross-section, its diameter in the case of a vessel with circular cross-section, its length in the case of a ladle with rectangular cross-section, etc. By positioning the lance 8 at this location, the additive 2 can be delivered to a location within the ladle 16 where the flow of the molten metal 15 is high relative to the rest of the ladle, thus providing better dispersion of the additive 2, as best seen in FIG. 1. This allows improvement of dispersion through the positioning of the lance 8 in addition to the improvement by the oscillation of the lance 8.

The distance that a particular wire 2 travels from conduit outlet 12 (i.e., the length of segment 13) before fully desolidifying in the molten metal 15 depends upon the wire feed rate and the oscillation or rotational speed of lance 8. Decreasing the thickness of wire 2, or changing from a clad to unclad wire will tend to increase the feed rate of wire 2 that provides the same or substantially the same travel distance. Also, a higher melt temperature could be accompanied by a higher feed rate of wire 2 to achieve the same or substantially the same travel distance.

In one example, wire 2 is an unclad calcium metal wire having a diameter of from about 8 mm. to about 12 mm.; lance 8 is straight and vertically-oriented in the molten metal bath 15; the wire outlet 12 of lance 8 is at the lower tip of the lance 8 and is positioned below the critical depth D; the distance between the longitudinal axis of the lance 8 and the inner surface of the nearest ladle side wall 11 is from about ⅙ to about ⅓ of the longest linear dimension L of the molten metal 15 (in a horizontal plane); the temperature of the ferrous molten metal 15 is from about 2800° F. to about 3000° F.; and the range for the feed rate of wire 2 is from about 100 ft./min. to about 1000 ft./min.

FIGS. 5-8 show an exemplary embodiment of a means for oscillating the lance 8 while feeding the additive wire 2, so that the outlet 12 of the lance 8 moves below the surface of the melt 18 of the molten metal 15 while feeding the additive wire 2.

Figure 5:
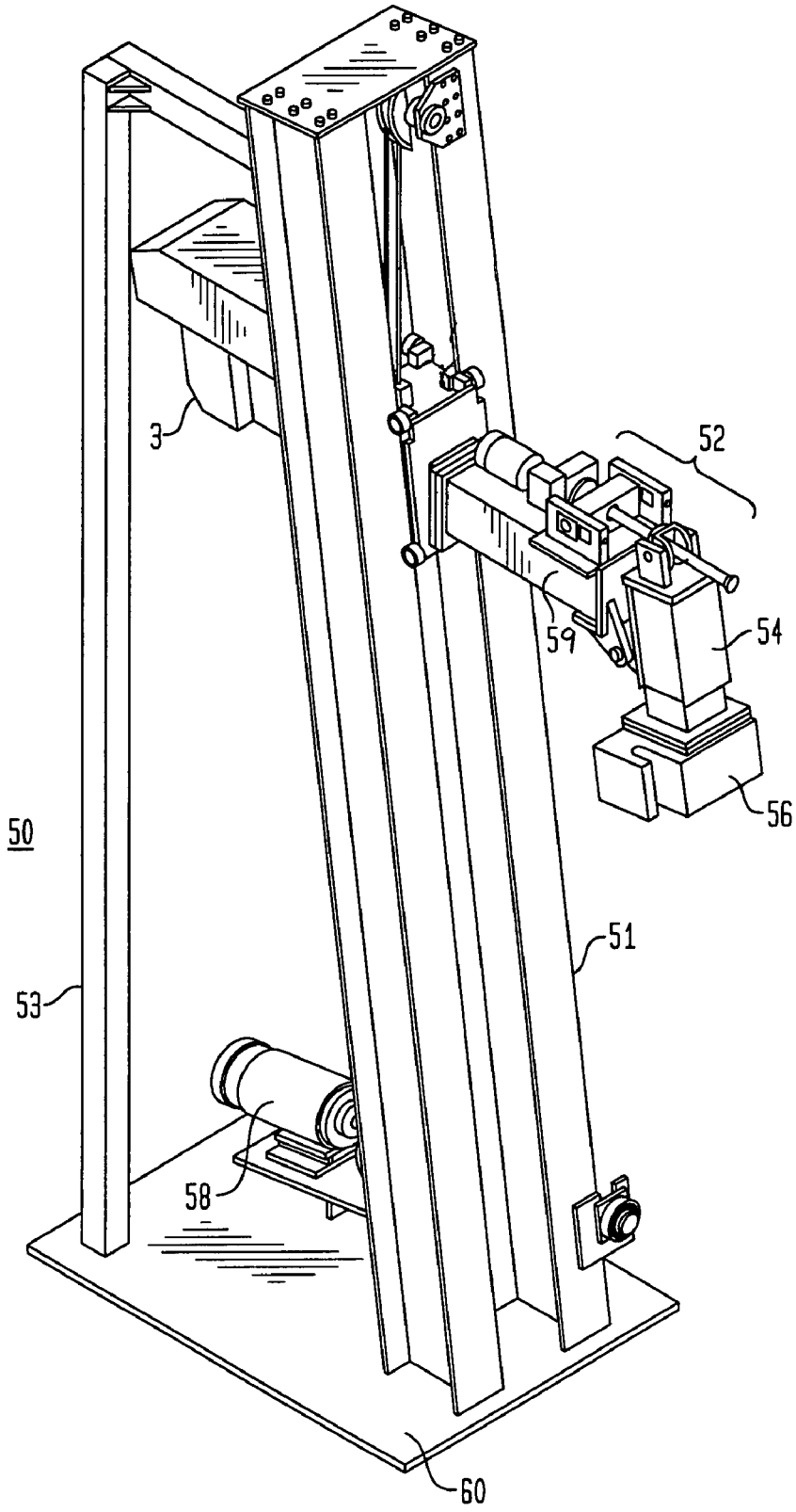
FIG. 5 is an isometric view of a hoist structure supporting the lance of FIG. 1.

FIG. 5 is an isometric view of a vertical wire injection lance unit 50. Lance unit 50 includes structural members, such as a base 60, and front and rear structural members 51 and 53. Hoisting drive components 58 may be mounted to the base 60 or another suitable structural member. The hoisting drive components 58 are used to raise and lower the lance 8. The hoisting drive components 58 feed and retract a cable coupled to the hoisting cart boom assembly 59. In embodiments in which the hoisting drive components 58 are below the hoisting cart boom assembly 59, the cable is redirected by a pulley 55.

Figure 8:
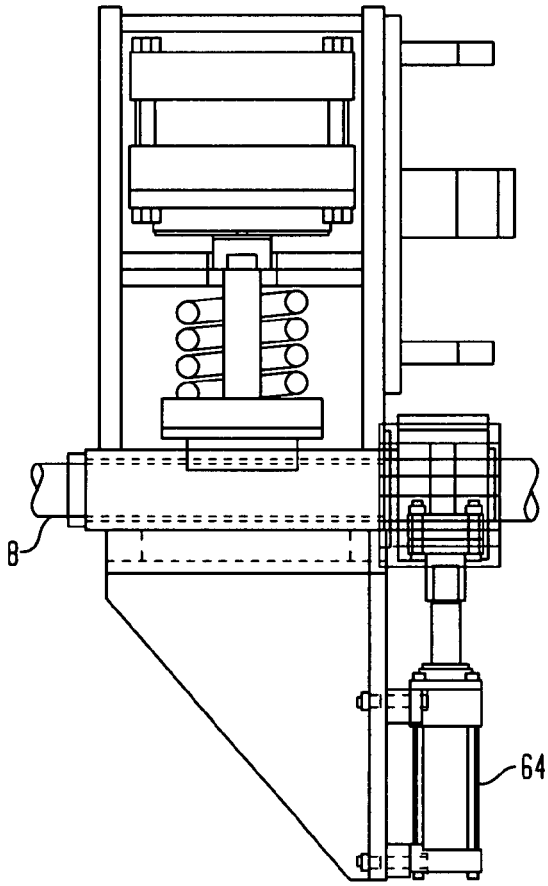
FIGS. 6-8 are plan, cross-sectional and side views of the mast assembly shown in FIG. 5.
Figure 6:
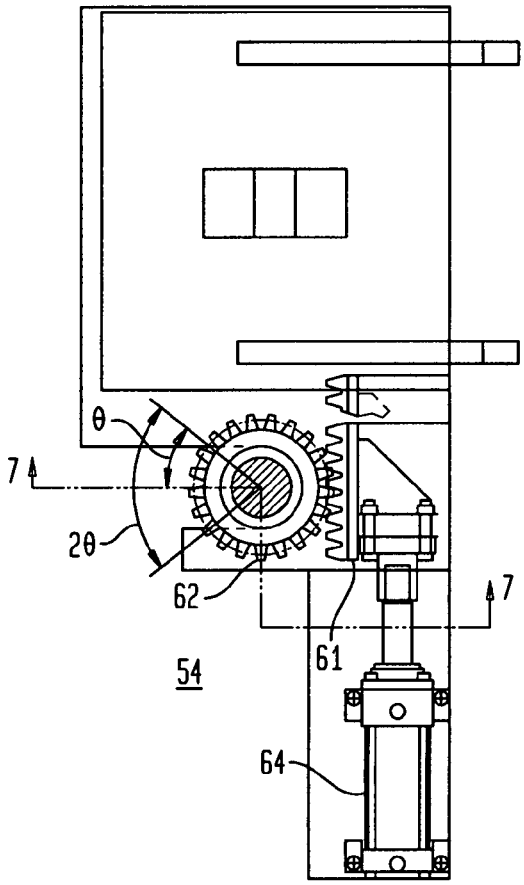
Figure 7:
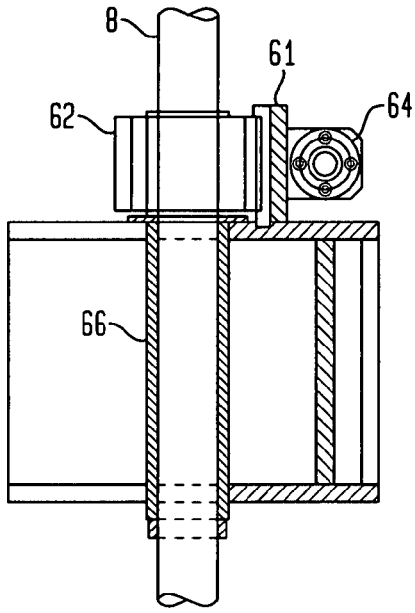

FIGS. 6-8 are diagrams showing the mast assembly 54 of FIG. 5. The mast assembly 54 includes a lance sleeve 66 for pivotally retaining the lance 8, and a rack 61 and pinion 62, for controlling the angle of rotation of the lance 8 about its longitudinal axis. The pinion 62 is driven by the rack 61, and rotates with the lance 8. The rack 61 is driven by a motor 64, which may be a continuous motor or a stepper motor, for example. The motor 64 is controlled by a controller (not shown), which may be, for example, an embedded microcontroller in (wired or wireless) communication with a statistical process controller or with the system operator's console. The oscillation of the lance 8 may be controlled to provide a constant angular velocity, or alternatively, to vary the angular velocity as the lance 8 sweeps through the path of its oscillation, to more evenly distribute the additive throughout the ladle 16. If the rotating capability of the lance 8 is just used for positioning the capability can be used to position the tip at best area for injection.

Although the invention has been described in terms of exemplary embodiments, it is not limited thereto. Rather, the appended claims should be construed broadly, to include other variants and embodiments of the invention, which may be made by those skilled in the art without departing from the scope and range of equivalents of the invention.

What is claimed is:

1. A method of feeding an additive to a molten metal in a vessel using a lance, said lance having an outlet, the method comprising:

positioning the outlet of the lance below the surface of the molten metal, oscillating the lance so that the outlet of the lance moves with a reciprocating motion below the surface of the molten metal, and dispensing the additive through the outlet of the lance along a path traversed by the outlet in the molten metal while the lance oscillates, and varying a speed of oscillating the lance while dispensing the additive.

2. The method of claim 1 wherein the oscillating step comprises oscillating the lance across an arc of about 0 degrees to about 210 degrees.

3. The method of claim 1 wherein the additive comprises a solid.

4. The method of claim 3 wherein the additive is one of the group consisting of calcium, carbon, iron, magnesium, calcium, aluminum or combinations thereof.

5. The method of claim 3 wherein the additive is compressed or extruded into a wire.

6. The method of claim 1 further comprising adjusting an elevation of the outlet of the lance with respect to a bottom of the vessel.

7. The method of claim 1 wherein the vessel is a furnace, an electric arc furnace or a ladle.

8. A method of feeding an additive through a lance into a molten metal in a vessel, comprising the steps of:

providing a lance having a conduit extending therethrough, said conduit having an upper section and lower section, said sections in communication with each other, said lower section having an outlet, and wherein a longitudinal axis of the upper section of the conduit is angled with respect to a longitudinal axis of the lower section of the conduit, inserting the lance within the vessel, positioning the outlet of the conduit below a surface of the molten metal in the vessel, oscilating the lance about the longitudinal axis of the upper section, so that the outlet of the lower section of the conduit moves with a reciprocating motion in the vessel, feeding the material through the conduit into the molten metal while the lance oscillates, so that the material is dispensed along a path traversed by the outlet of the lower section of the conduit in the molten metal, and adjusting an oscillation speed of the lance while feeding the material.

9. The method of claim 8 wherein the additive is an extruded metal or metal alloy wire.

10. The method of claim 8 further comprising adjusting an elevation of the outlet of the lower section of the conduit with respect to a bottom of the vessel.

11. The method of claim 8 wherein the additive is selected from the group consisting of calcium, carbon, iron, magnesium, aluminum or combinations thereof.

12. The method of claim 8 wherein the vessel is a furnace, electric arc furnace, or a ladle.

13. The method of claim 8 wherein the axis of the upper section of the conduit with respect to the axis of the lower section is from about 3 to about 90 degrees.

14. The method of claim 8 further comprising controlling a rate of addition of the wire to the molten metal using a wire feeding mechanism.

15. The method of claim 8 wherein the angle traversed by the outlet of the conduit is from about 0 to about 210 degrees.

16. A lance for feeding an additive wire into a vessel containing a molten metal, said lance having an outlet end, said lance comprising:

a refractory housing, an annular conduit within the housing through which the additive wire is fed into the molten metal, and means for oscillating the lance while feeding the additive wire, so that the outlet of the lance moves below the surface of the molten metal while feeding the additive wire, the means for oscillating including a variable speed motor configured to vary a speed of oscillating the lance while feeding the additive.

17. The lance of claim 16 wherein the vessel is a furnace, electric arc furnace, or a ladle.

18. A lance for feeding an additive wire into a vessel containing a molten metal rising:

a refractory housing, a conduit located within said housing, through which the additive wire is fed into the molten metal, said conduit having an upper section and a lower section, said sections in communication with each other, wherein a longitudinal axis of said upper section is angled with respect to a longitudinal axis of the lower section, and, a motor for oscillating the lance so that the lower section moves along an arc below the surface of the molten metal while feeding the additive wire, the means for oscillating including a variable speed motor configured to vary a speed of oscillating the lance while feeding the additive.

19. The lance of claim 18 wherein the axis of the upper section of the conduit with respect to the lower section of the conduit is from about 3 to about 90 degrees.

20. The lance of claim 18, wherein the lance further comprises:

a lance sleeve for pivotally mounting the refractory housing on a structure, and a rack and pinion coupled to the motor, for controlling the angle of rotation of the lance about the longitudinal axis.

21. The lance of claim 20, wherein the structure is a hoist having a hoist drive component for raising and lowering the lance sleeve.

22. The method of claim 1, wherein the oscillating includes rotating the lance about the longitudinal axis of the lance using a rack and pinion.

* * * * *